US005582315A

United States Patent [19]

Reid

[11] Patent Number: 5,582,315

[45] Date of Patent: Dec. 10, 1996

[54] POUR SPOUT CLOSURE WITH HANDLE

[75] Inventor: Grahame W. Reid, Novato, Calif.

[73] Assignee: Innovative Molding, Inc., Sebastopol, Calif.

[21] Appl. No.: 297,750

[22] Filed: Aug. 30, 1994

[51] Int. Cl.[6] ..... A47G 19/22

[52] U.S. Cl. ..... 220/254; 220/367.1; 220/705; 220/710.5; 220/714; 220/763; 220/764; 215/389; 222/520; 222/548; 222/570

[58] Field of Search ..... 220/367, 705, 220/710.5, 716, 717, 719, 760, 762, 763, 764, 714, 373, 374, 367.1, 254; 222/519–520, 526, 528–533, 538, 548, 570–571, 465.1; 16/342, 112; 215/387–389

[56] References Cited

U.S. PATENT DOCUMENTS

| | | | |
|---|---|---|---|
| D. 315,103 | 3/1991 | Bennett . | |
| 1,166,551 | 1/1916 | Simmons | 16/342 |
| 2,622,922 | 12/1952 | Schroeder | 16/342 X |
| 3,655,103 | 4/1972 | Hazard | 222/530 |
| 3,924,775 | 12/1975 | Andreaggi et al. | 220/764 X |
| 3,949,897 | 4/1976 | Shaw et al. | 220/373 X |
| 4,630,333 | 12/1986 | Vickers | 16/342 X |
| 4,887,747 | 12/1989 | Ostrowsky et al. | 222/532 X |
| 5,242,079 | 9/1993 | Stephens et al. | 222/570 X |

OTHER PUBLICATIONS

"Toppers Tappers" brochure, Jareen, distributed Spring 1993.

*Primary Examiner*—Gary E. Elkins

*Assistant Examiner*—Nathan Newhouse

*Attorney, Agent, or Firm*—Thomas M. Freiburger

[57] ABSTRACT

A threaded closure for large-mouth containers has a handle which swings up or down on a horizontal pivot, and closes a vent hole when in the downward position. A pour spout rotates on an inclined off-vertical axis, to store the pour spout closely alongside the top surface of the closure, sealing off the pour spout, or to rotate outward to an upwardly inclined pouring position in which the spout is open. The vent hole in the top of the closure has a negative draft for a snap fit with a nipple or plug on the handle. Another preferred element of the closure construction is that the handle is held onto the closure body with polygonally shaped pegs extending into similarly shaped holes in the closure body. The handle thus tends to stay in different selected positions when pouring. The plastic handle itself is molded to a smaller reach width, so that it is stretched when assembled and continuously exerts a force inward against the closure body, reliably holding the pegs in the holes. Another feature of the invention relates to the pour spout seal, which includes an upwardly dome-shaped surface on the closure, so that when the pour spout or spigot is snapped into place, a chamber-dividing web of the pour spout wipes across this domed surface with sealing pressure constantly exerted.

2 Claims, 4 Drawing Sheets

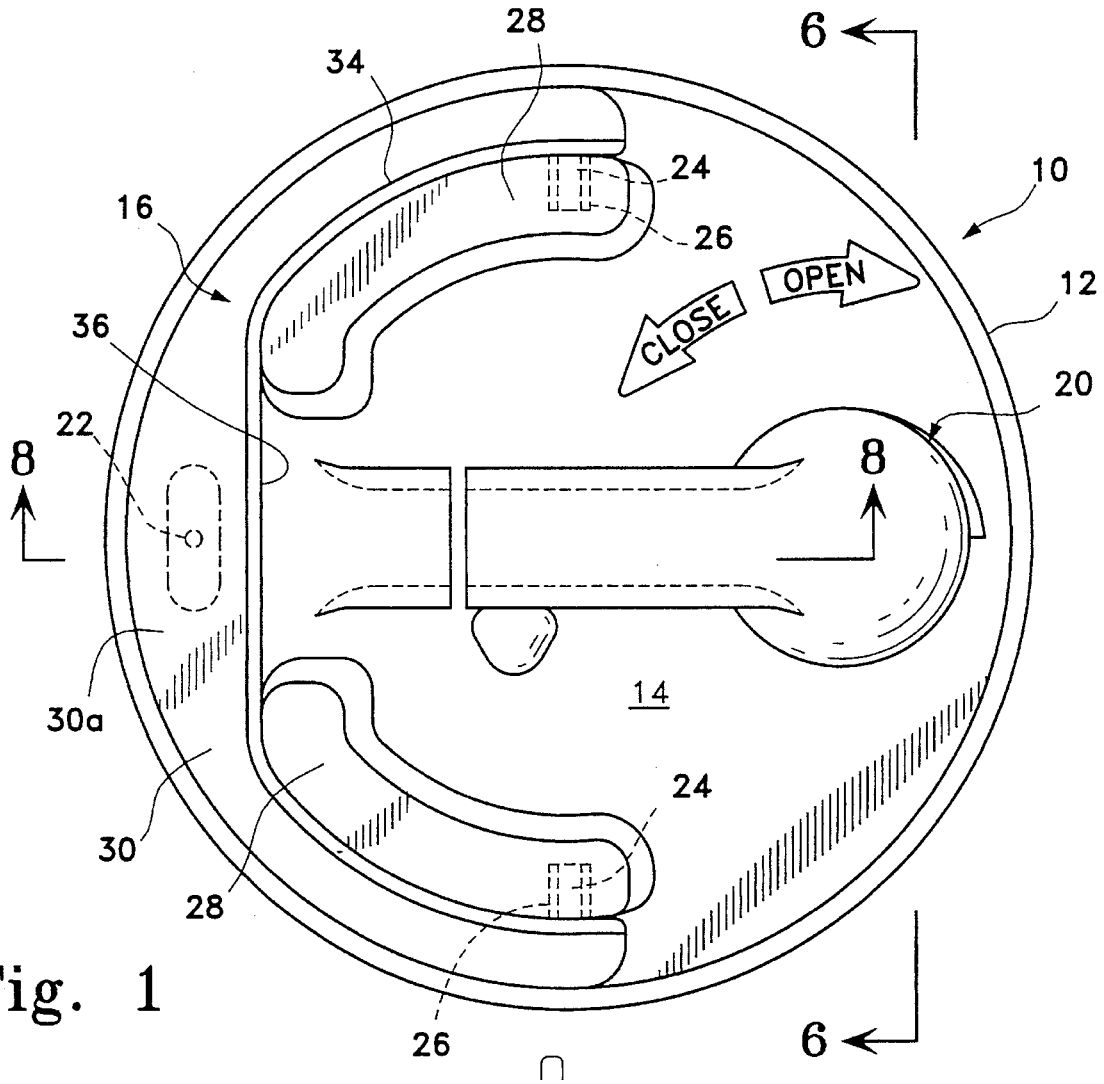
Fig. 1
Fig. 2
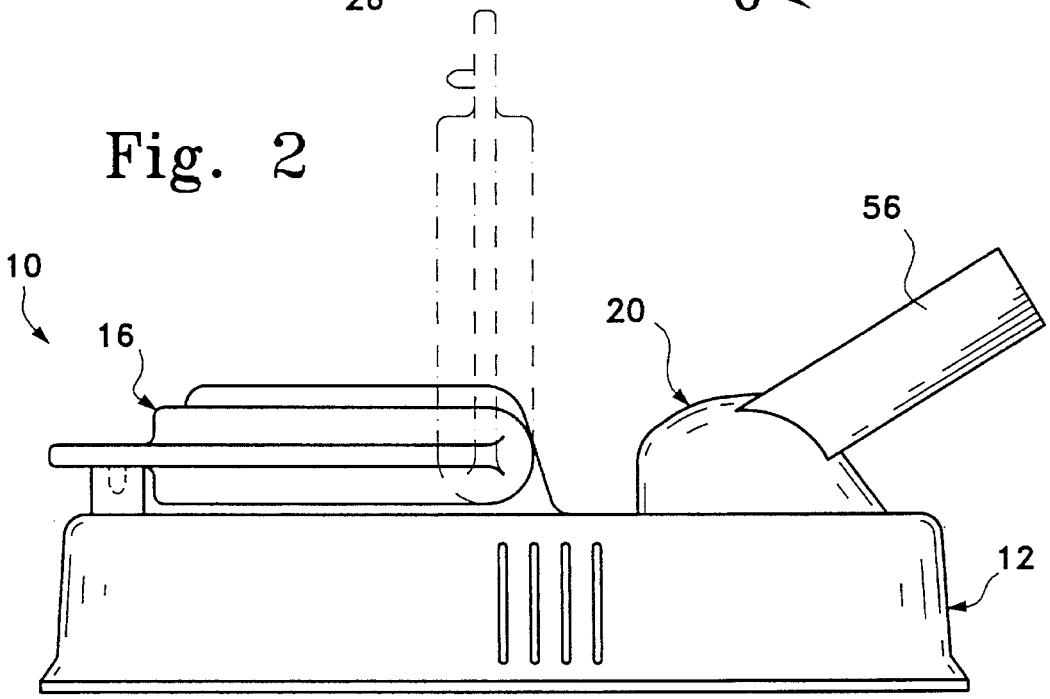

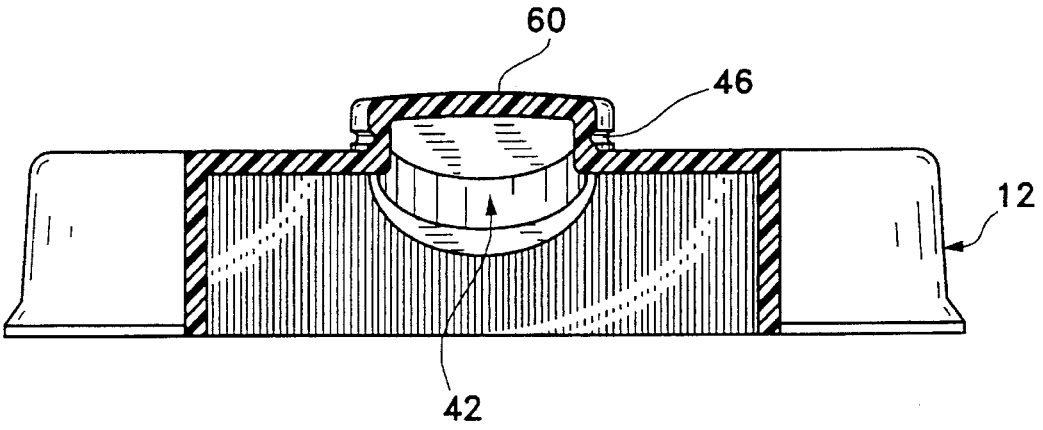
Fig. 6
Fig. 7
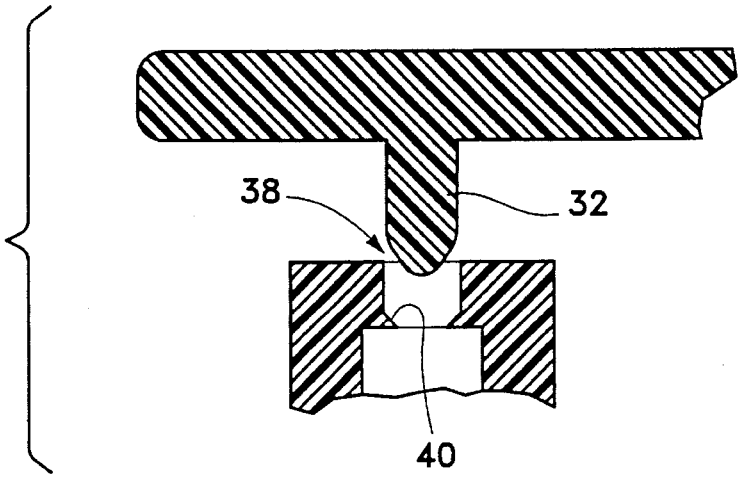
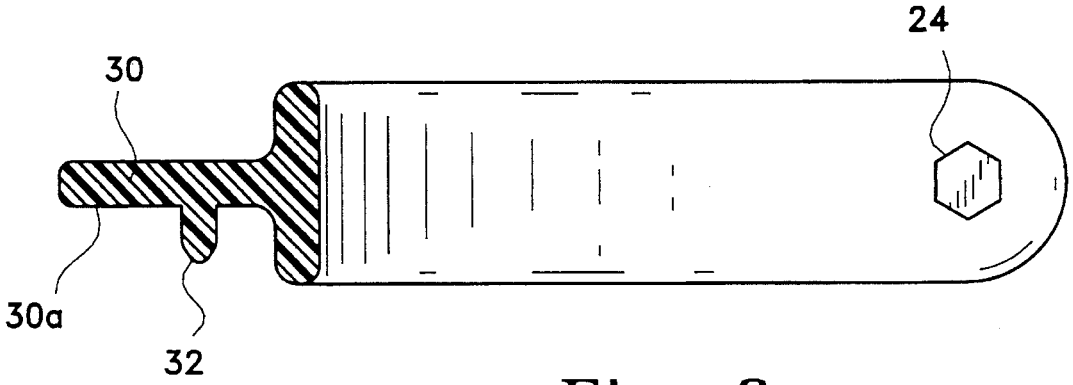
Fig. 8

POUR SPOUT CLOSURE WITH HANDLE

BACKGROUND OF THE INVENTION

This invention is concerned with container closures, and more specifically with a threaded closure for a large-mouth container, e.g. with a three-inch or greater diameter finish, the closure including an openable/closable pour spout and an upwardly pivotable handle for carrying the container and for holding the container for pouring.

A dispensing spout is often desirable for containers carrying liquids. It is desirable to have a pour spout forming a part of a closure for the container, preferably with the pour spout movable from an open, dispensing position to a closed and sealed position.

Such a container closure has been produced and has been in commercial use. A container closure of the type generally described has been known for container finish diameters of about 110 mm finish diameter, and have included a separately molded pouring spout structure which was snapped onto a boss on the top of the closure body for rotation on a slightly off-vertical oblique axis. When pivoted to an outward position, the pour spout extended over the edge of the closure body and at an upward angle for pouring, and this was effective to open the pouring spout to the liquid in the container below, through an opening at one side of the boss on the container body. When swung 180° to a closed, storage position, the pour spout structure had a sealing wiper which rotated to block off the opening leading into the container, with the purpose of forming a seal against leakage of liquid from the container.

Further, this known closure structure had a pivoted handle, swingable on a horizontal axis from a flat position down against the top surface of the closure body to an upper position for holding the container by the handle while pouring. The known closure assembly had a vent opening in the top of the closure body, on a side opposite the location of the spigot. A vent plug or nipple on the pivotable handle was positioned to engage into the vent hole to seal the vent opening when the handle was swung down to the lower, horizontal position.

It has been found that the described closure assembly was not fully effective in sealing against leakage of liquid through the pour spout structure when the pour spout or spigot was in the closed position. Also, the vent plug did not engage in the vent in such a way as to completely seal the vent while engaging tightly therein, sufficiently tight that the handle would not jar loose during transportation or handling, while still not requiring a great deal of force to close the vent.

It is an object of this invention to improve the sealing characteristics of such a closure assembly, providing a fully effective seal, to improve the vent closing arrangement cooperating between the handle and the closure body, and to improve the closure structure in several other aspects.

SUMMARY OF THE INVENTION

In the improved pour spout closure of the invention described herein, the pour spout is made to effectively seal against leakage by use of a sealing wiper which is convex and engages an opposing slightly domed, convex surface on a boss or raised region of the closure body onto which the pour spout structure is assembled by a snap-on engagement. The opposing curved shapes, i.e. opposing convex surfaces of this arrangement, provide a biasing preload between the sealing wiper of the rotatable pour spout structure and the relatively thin surface of the boss or raised region of the closure body. Leakage of liquid across the sealing wiper, when the pour spout is in either the closed or open position, is effectively prevented.

Another feature of the invention is in the structure of the vent hole in the top of the closure body. A negative draft is included in this vent hole, so that it tapers to a tighter diameter at its bottom end, thus forming a narrow region of interference fit between the vent plug carried by the handle and the vent hole. Preferably the vent plug comprises a straight sided cylindrical peg, while the vent hole includes an inward taper or chamfer at the bottom of the hole. The engagement between the vent plug and vent is tight and positive, with the plastic components yielding slightly to make a high friction sealing fit between them, a fit which will retain the handle and vent plug in this position until the handle is deliberately pivoted upwardly.

A further feature of the improved closure coacts between the handle and closure body to establish several different angularly raised positions of the handle in which the handle tends to stay after being placed.

Accordingly, primary objectives of the invention are to improve the sealing characteristics of a pour spout closure for a relatively wide mouth container of the type described, as well as to provide a more reliable vent closure, greater convenience in operation of the handle and other improvements described below. These and other objects, advantages and features of the invention will be apparent from the following description of a preferred embodiment, considered along with the accompanying drawings.

DESCRIPTION OF THE DRAWINGS

FIG. 1 is a plan view showing a pour spout type container closure in accordance with the invention.

FIG. 2 is a side elevation view showing the pour spout closure and indicating the pivoting arc for a handle of the closure.

FIG. 6 is a detail view in cross section showing a portion of the closure and illustrating a feature relating to sealing of the pour spout structure with the closure body, as seen along the line 6—6 in FIG. 1.

FIG. 7 is a detail view showing a vent hole and vent plug which form a part of the container closure of the invention.

FIG. 8 is a detail view in cross section showing the separately molded handle, as seen generally along the line 8—8 in FIG. 1 but showing only the handle and not the remaining components of the closure assembly.

DESCRIPTION OF PREFERRED EMBODIMENTS

Figure 3:
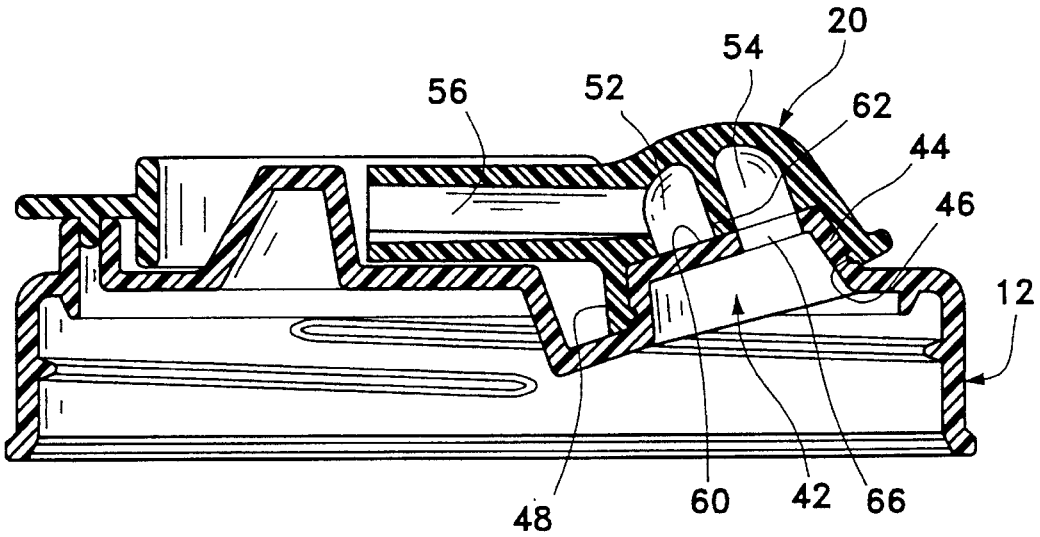
FIG. 3 is an elevational cross section showing the closure of FIGS. 1 and 2.

FIG. 1 shows a container closure assembly 10 which includes a circular closure body 12 having a top panel 14, the closure body having connected to it a handle generally identified at 16 and a pour spout and sealing structure 20. As noted earlier, the general form of closure assembly 10 shown in FIG. 1, with a rotatable pour spout 20 which seals in the closed position shown and opens the container to pouring in a 180°-opened position, and with a handle which pivots down to close a vent hole 22, has been known from prior commercial use. The known closure assembly, having a finish diameter of about 110 mm, had problems relating to leakage of the pour spout structure 20 particularly when in the closed position and had other shortcomings which are overcome by the invention described herein and shown in the drawings.

As seen in the drawing figures, the handle 16 of the closure engages with the closure body 12 via a pair of pegs 24 shown in dotted lines in FIG. 1 and one of the pegs 24 being seen in FIG. 8. These pegs engage in holes 26 indicated in FIG. 1 but best seen in the perspective view of FIG. 9. The holes 26 are formed in raised portions, i.e. high bosses 28 formed in the upper surface of the closure body 12. These bosses 28 also outline the position of the handle 26 when in its lower, closed position as shown particularly in FIG. 1 and also in FIG. 2.

FIG. 1 and FIG. 8 show one preferred feature of the invention, whereby, as discussed previously, the handle 16 when raised up to a gripping position will tend to remain in a particular raised position. This is pursuant to the inclusion of one or more flats on the pegs 24 and corresponding flats in the peg receiving holes 26. One preferred embodiment illustrated in FIGS. 1 and 8 shows each peg 24 in a hex shape, with the receiving holes 26 preferably shaped similarly.

Another feature of the handle 16 is that it is injection-molded to a smaller reach width than the outer distance defined by the raised bosses 28. Thus, the molded plastic handle, after stretching to spread the pegs 24 for assembly into the holes 26, tends to be biased toward its smaller reach width as molded, thus exerting a constant mild clamping force against the bosses 28 and retaining the pegs 24 securely in the holes.

FIGS. 2, 3 and 8 show a preferred shape of the handle 16, with a flat flange 30 extending around the generally semi-circular circumference and becoming wider at the top area 30*a* of the handle, for location of a vent closing peg 32 in this area. The flange 30 adds rigidity and strength to the handle, which may carry a fairly heavy load depending on the contents of a container (not shown) to which the closure 10 is secured. The handle also has another flange 34, perpendicular to the flange 30 which defines the inner edge of the handle and provides a relatively flat gripping surface for the user's hand. This flange 34 may be flat at a central, upper area 36 as shown in the drawings.

The vent stopper plug 32 preferably is formed as a generally cylindrical integral extension of the flange 30, as shown in FIGS. 2, 3 and 8 of the drawings. It may have a very slight draft as needed for the injection molding operation, but is essentially cylindrical. This peg or plug 32 extends into a vent hole 22 formed during the molding process in the closure body 12, as can be seen in several of the drawing figures, but particularly in the perspective view of FIGS. 7 and 9. This vent hole, in accordance with the invention, is formed with a "negative draft" 40, forming an inward taper generally at the bottom of the hole as shown in FIG. 7. The diameter at the bottom of this negative hole is less than that of the cylindrical peg or plug 32 so that the plastic material will deform when the plug is forced into the hole 38. The upper diameter of the hole 38 receives the plug 32 loosely, or with a slight frictional contact, with sealing and gripping force primarily occurring at the negative draft or inward taper 40.

As an example, the plug or peg 32 may have a diameter of about 0.125 inch. The upper portion of the vent hole 38 may have a similar diameter. At the bottom of the vent hole, the negative draft may take the diameter down to about 0.120 inch. The plastic material from which the handle 16 and the closure body 12 are formed in a preferred embodiment is polypropylene. The pour spout structure 20 in a preferred embodiment, is a linear low density polyethylene, but could also be low density polyethylene. Improved sealing characteristics are achieved using dissimilar plastic materials. It is generally undesirable to use like plastic materials in intimate fit circumstances because of creep characteristics of plastic materials.

Figure 4:
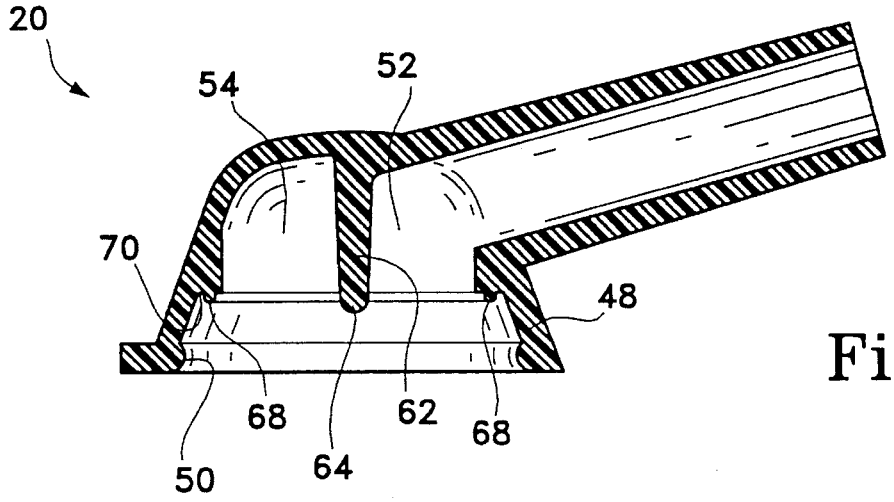
FIG. 4 is an elevational cross section showing a pour spout structure which is separately molded and which forms a part of the closure of the invention.
Figure 5:
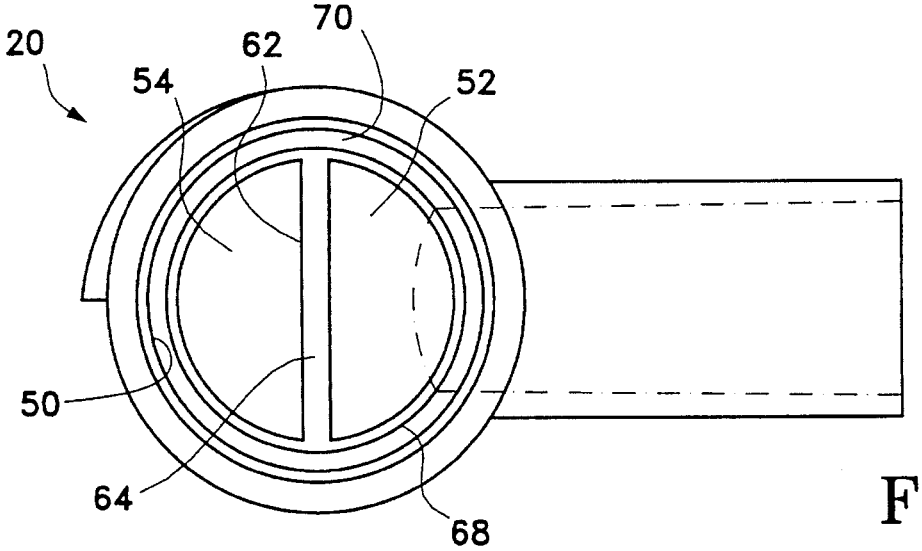
FIG. 5 is a bottom plan view of the pour spout structure shown in FIG. 4.
Figure 9:
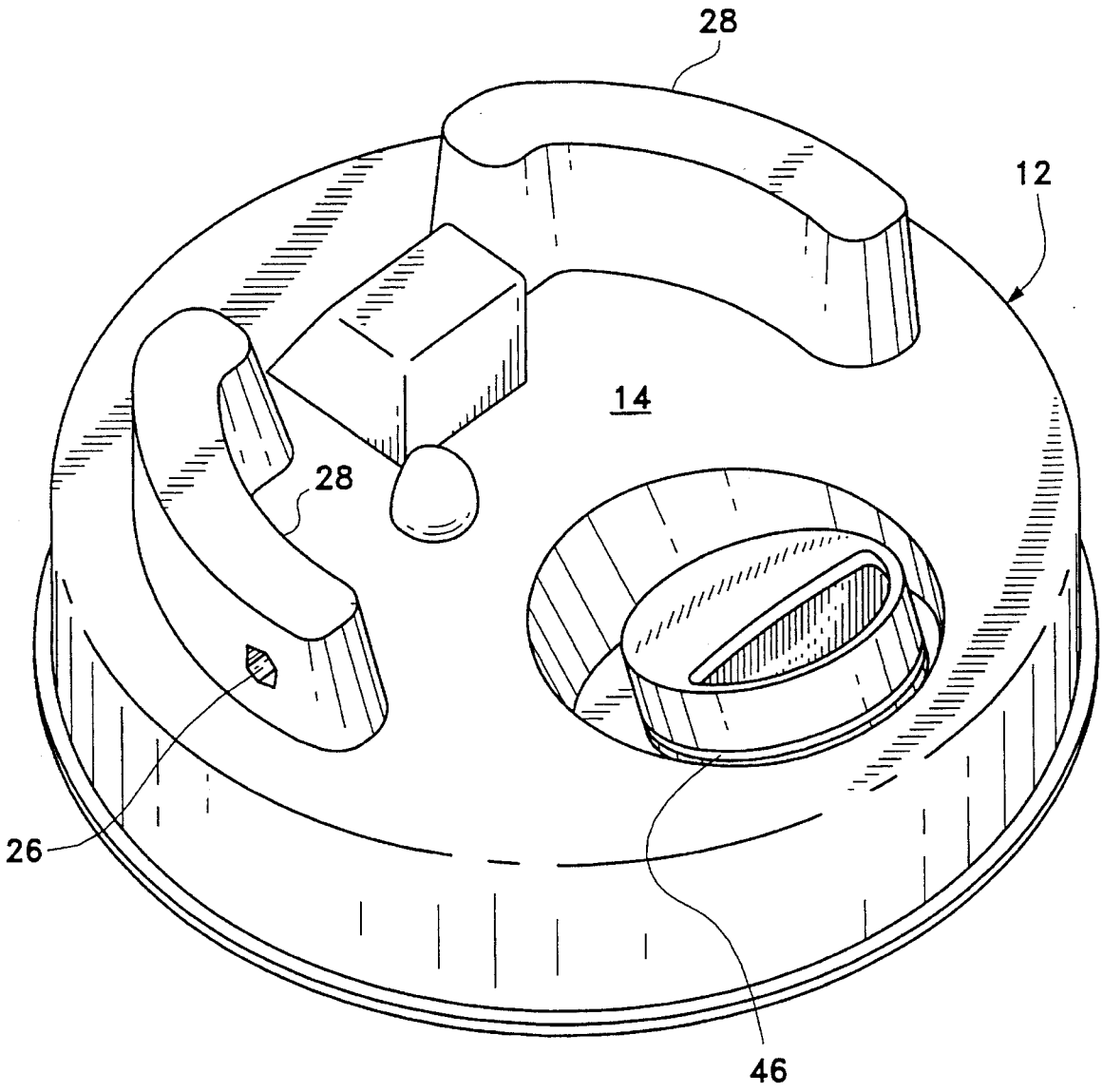
FIG. 9 is a perspective view showing the upper surface of the closure body, without the handle and pour spout structure.

Another important feature of the invention is structure enabling effective sealing of the pour spout or spigot and seal component 20 with the closure body 12. FIG. 3 shows in cross section the general configuration of the connection between the spigot structure 20 and the closure body 12. FIGS. 4, 5 and 9 also show features of this assembly. As indicated, the closure body 12 has an integrally formed raised region 42, which preferably extends upwardly at an off-vertical oblique angle as shown. The raised region comprises a boss having a sloped circumferential wall 44 with a groove 46 near its bottom. This sloped outer wall 44 is shaped to be engaged downwardly by a bell-shaped rim 48 of the pour spout or spigot structure 20. The bell-shaped portion 48 slips down over the sloped wall 44 of the raised region 42, and an inwardly facing ridge 50 at the bottom of the bell-shaped portion snaps into the groove 46, firmly holding the spigot structure 20 in place. The component 20 includes a pair of chambers 52 and 54, i.e. a pouring chamber and a closing chamber, in the upper part of the bell-shaped portion. The pouring chamber 54 communicates directly with a spigot tube or pour spout tube 56 as shown.

The closure structure of the invention improves the seal integrity and provides a leakproof connection between the closure body 12 and the spigot structure 20. As shown in FIG. 6, which is a transverse section through the closure body taken along line 6—6 in FIG. 1, shows the closure body 12 prior to assembly with the other two components, and reveals that the raised region 42 is molded with a domed shape to its upper surface 60. This dome may be generally arcuate and may have a height difference of about 0.010 inch at its center compared to the shoulders. The preferred thickness of this domed top surface 60 is in the range of about 0.015 to 0.020 inch, for the type of plastic material disclosed above. FIG. 9 also shows the domed surface 60.

Cooperating with the domed surface 60 in the raised region 42 is a web or chamber divider 62 integrally formed in the bell portion 48 of the spigot structure 20. This web preferably has a curved bottom surface 64, bowed downwardly somewhat for engagement against the domed upper surface 60 of the closure structure 12. As an example, a preferred displacement due to downward curvature at the bottom edge of this wall or divider 62 may be about 0.005 inch, protruding lower than the wall at its edges. As can be envisioned from FIG. 3, when the spigot structure 20 is snapped down over the raised region 42, the opposed convex surfaces of the web or wall 62 and the domed upper surface of the raised region are stressed and the domed upper surface 60 is deflected somewhat. The surfaces remain under adequate pressure, in the sealed position and in the opened position (FIG. 2 shows the opened position), to maintain a constant and effective seal between the two chambers 52 and 54, i.e. between an opening 66 in the closure 12 and the pouring tube 56.

Also assisting in sealing between the components 20 and 12 is an annular sealing ridge 68 which extends around the periphery of the two chambers 52 and 54 as shown in FIGS. 4 and 5. This annular ridge 68 preferably is flush with the bottom edge 64 of the web or wall 62 at the ends of the wall 62 as shown in FIG. 5 (but not flush with the middle of the web 62, which extends downwardly), with a resulting recess or groove 70 just outward of the sealing ridge 68, adjacent to the inner surface of the bell portion wall 48. The annular sealing ridge 68 provides a tight seal between the inner circumference of the spigot component 20 around the chambers 52 and 54 and the upper shoulder annulus of the raised region 42 of the closure body 12. In one preferred embodiment the annular sealing ridge 68 protrudes about 0.005 inch lower than the adjacent grooved annulus 70 immediately surrounding this ridge.

The above described preferred embodiments are intended to illustrate the principles of the invention but without limiting its scope. Other embodiments and variations to these preferred embodiments will be apparent to those skilled in the art and may be made without departing from the essence and scope of the invention as defined in the claims.

I claim:

1. A pour spout closure for a relatively large mouth container, of the type wherein a pour spout or spigot rotates from a closed position rotated back toward the center of the closure and an open position projecting outwardly over the edge of the closure, and wherein a pivoted handle secured to the closure body swings up to a position for carrying the weight of the closure and container and swings down to a position against an upper surface of the closure body, comprising:

the closure comprising a raised region at the top of the closure body, having a downwardly and outwardly sloped, substantially annular circumferential wall with an annular groove at the bottom of the wall and a slightly upwardly domed top surface on the raised region, with an opening at one side of the domed top surface, and the pour spout or spigot further including a generally bell-shaped base portion and a generally tubular pour spout portion, the pour spout communicating with a first chamber in the base portion, and there being a second chamber in the base portion divided from the first chamber by a dividing wall, and the pour spout including an annular flange for assembling down over and snapping into the annular groove on the circumferential wall of the raised region of the closure body, the dividing wall between the two chambers being arched convexly downwardly so that it will engage with an interference or biasing preload against the domed top surface of the raised region, so that when snapped together onto the raised region, the dividing wall of the pour spout structure slightly displaces the domed top surface and engages the domed top surface tightly in a preloaded wiper seal arrangement, whereby the preload between the dividing wall and the domed top surface of the raised region on the closure body effectively prevents leakage from the open side of the raised region's top surface across to the chamber connected to the tubular pouring spout.

2. The closure construction of claim 1, further including an annular ridge surrounding the two chambers in the base portion of the pour spout component, positioned to engage downwardly with a sealing pressure against an annular region of a shoulder at the periphery of the domed top surface of the raised region when the pour spout component is snapped together onto the closure body, to further seal against leakage between the closure body an the pour spout component.

* * * * *